US007949279B2

(12) United States Patent
Takahashi

(10) Patent No.: US 7,949,279 B2
(45) Date of Patent: May 24, 2011

(54) IMAGE FORMING APPARATUS AND CONTROL METHOD THEREOF

(75) Inventor: Hiroyuki Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 12/484,907

(22) Filed: Jun. 15, 2009

(65) Prior Publication Data

US 2009/0317122 A1 Dec. 24, 2009

(30) Foreign Application Priority Data

Jun. 18, 2008 (JP) ..... 2008-159668

(51) Int. Cl.
*G03G 15/00* (2006.01)

(52) U.S. Cl. ..... 399/82

(58) Field of Classification Search ..... 399/82, 399/87, 46, 66, 67, 399, 397, 405
See application file for complete search history.

(56) References Cited

U.S. PATENT DOCUMENTS 5,478,062 A * 12/1995 Horiuchi et al. ..... 270/58.08
5,852,764 A * 12/1998 Kida et al. ..... 399/401
6,427,058 B1 * 7/2002 Akiba et al. ..... 399/82
2005/0147427 A1 * 7/2005 Felix ..... 399/82

FOREIGN PATENT DOCUMENTS

JP 11-10962 A 6/2004

* cited by examiner

*Primary Examiner* — David P Porta
*Assistant Examiner* — Kiho Kim
(74) *Attorney, Agent, or Firm* — Canon U.S.A., Inc. IP Division

(57) ABSTRACT

An image forming apparatus includes an input unit configured to input image data, an image processing unit configured to process the image data, a transfer unit configured to form a developer image corresponding to the processed image data and transfer the developer image onto a sheet, a fixing unit configured to fix the developer image, a conveyance unit configured to convey a plurality of sheets at predetermined conveying intervals to the transfer unit and the fixing unit, and a control unit configured to control the transfer unit and fixing unit such that a developer image corresponding to image data of a page is not transferred onto a sheet and the sheet is conveyed to the fixing unit if an image processing with respect to the image data of the page has not been completed.

10 Claims, 13 Drawing Sheets

IMAGE FORMING APPARATUS AND CONTROL METHOD THEREOF

BACKGROUND OF THE INVENTION

1. Field of the Invention

The present invention relates to an image forming apparatus and a control method of the image forming apparatus.

2. Description of the Related Art

An image forming apparatus starts conveying a sheet, which has been kept standby at a registration roller pair, after finishing rasterization of image data. The image forming apparatus transfers a developer image corresponding to the rasterized image data, onto the conveyed sheet and fixes the developer image on the sheet, thereby achieving an image formation on the sheet.

Recently, many high speed image forming apparatus have been conveying sheets to a transfer unit and a fixing unit at regular time intervals. In the high speed image forming apparatus, the fixing unit is configured to be continuously heated at a constant temperature such that a temperature decrease caused by a sheet passing through the fixing unit can be compensated by conveyance time intervals of sheets. FIG. 10 illustrates a temperature change of the fixing unit when normal printing of a plurality of pages is performed. In FIG. 10, the temperature of the fixing unit is kept at an optimum temperature for fixing an image onto a sheet by compensating the temperature decrease caused by the sheet passing through the fixing unit with the conveyance time intervals of sheets.

However, when the fixing unit has the above described configuration, if one page takes longer time to process an image, the temperature of the fixing unit may become higher than the optimum temperature. This situation arises when a standby time of the sheet at the registration roller pair becomes longer, therefore, it takes longer time to rasterize the image data, i.e., a fixing device continues to be heated during the rasterization, resulting in increase of a temperature of the fixing device. If the temperature of the fixing device becomes equal to or more than the temperature optimum for fixation processing due to the above described temperature increase, the image forming apparatus is kept in a standby state while a heater of the fixing device is turned off in order to decrease the temperature of the fixing device to the temperature optimum for the fixation processing.

FIG. 11 illustrates a temperature change of the fixing unit when a cycle down occurs in printing a plurality of pages. In FIG. 11, it takes a longer time to fix image data on a third page, resulting in bringing the fixing unit to a temperature over the degree optimum for fixing an image on a sheet (to an abnormal temperature). If the temperature of the fixing unit increases to the abnormal temperature, heating at the fixing unit needs to be once stopped to wait until the temperature of the fixing unit recovers to the optimum temperature. It is called the cycle down. In FIG. 11, the fixation processing of image data is restarted with respect to the image data of the third page after performing the cycle down, i.e., after the temperature of the fixing unit recovers to the optimum temperature.

Japanese Patent Laid-open Publication No. 11-10962 discusses a method for minimizing decrease of an overall throughput in an image forming apparatus making prints by effectively utilizing time even with respect to extremely complicated print data.

In the method discussed in the Japanese Patent Application Laid-Open No. 11-10962, bit map data is created for each of color components when a multicolor printing is performed on a print medium, such as a card or a label, which are conveyed at a constant speed. If the bit map images, which are to be printed onto the print medium, cannot be timely created although the print medium has been conveyed to a position where the printing is to be performed, the printing of the immediately preceding print medium is performed. After finishing the printing, the print medium is reversely conveyed, and printing of the bit map data which could not be timely created is performed. After finishing the printing of that data, the process is returned to a normal direction and the normal processing is recovered.

However, the method in the Japanese Patent Application Laid-Open No. 11-10962 discusses only switchback of a sheet and the temperature increase of the fixing unit cannot be effectively prevented. Further, since the recent printers were basically configured to be high speed printers, it is extremely difficult to carry out the switchback of the sheet while keeping the high speed during print processing.

SUMMARY OF THE INVENTION

The present invention is directed to an image forming apparatus configured to control processing of a transfer unit and a fixing unit with respect to a second sheet following a first sheet depending on whether an image processing of image data of the second page following the first page has been completed, and a control method of the image forming apparatus.

According to an aspect of the present invention, an image forming apparatus includes, an input unit configured to input image data, an image processing unit configured to process the image data, a transfer unit configured to form a developer image corresponding to the processed image data on a photosensitive member and transfer the developer image onto a sheet, a fixing unit configured to fix the developer image on the sheet, a conveyance unit configured to convey a plurality of sheets at predetermined conveying intervals from a predetermined position on a conveyance path to the transfer unit and the fixing unit, and a control unit configured to control the transfer unit and the fixing unit such that, when a second sheet following a first sheet is conveyed from the predetermined position by the conveyance unit after the first sheet has been conveyed to fix a developer image corresponding to processed image data of a first page by the conveyance unit, a developer image corresponding to image data of a second page is transferred onto the second sheet by the transfer unit and the second sheet is conveyed to the fixing unit if an image processing with respect to the image data of the second page following the first page has been completed, whereas the developer image corresponding to the image data of the second page is not transferred onto the second sheet by the transfer unit but the second sheet is conveyed to the fixing unit if the image processing with respect to the image data of the second page has not been completed. According to another aspect of the present invention, an image forming apparatus includes, an input unit configured to input image data, an image processing unit configured to process the image data, a transfer unit configured to form a developer image corresponding to the processed image data and transfer the developer image onto a sheet, a fixing unit configured to fix the developer image on the sheet, a conveyance unit configured to convey a plurality of sheets at predetermined conveying intervals from a predetermined position to the transfer unit and the fixing unit, and a control unit configured to control the transfer unit and the fixing unit such that, after a developer image corresponding to processed image data of a first page has been transferred onto a first sheet, a developer image corresponding to image data of a second page is transferred onto a second sheet if an image processing with respect to the image data of the second page has been completed, whereas the developer image corresponding to the image data of the second page is not transferred onto the second sheet if the image processing with respect to the image data of the second page has not been completed, and the second sheet is conveyed to the fixing unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Figure 1:
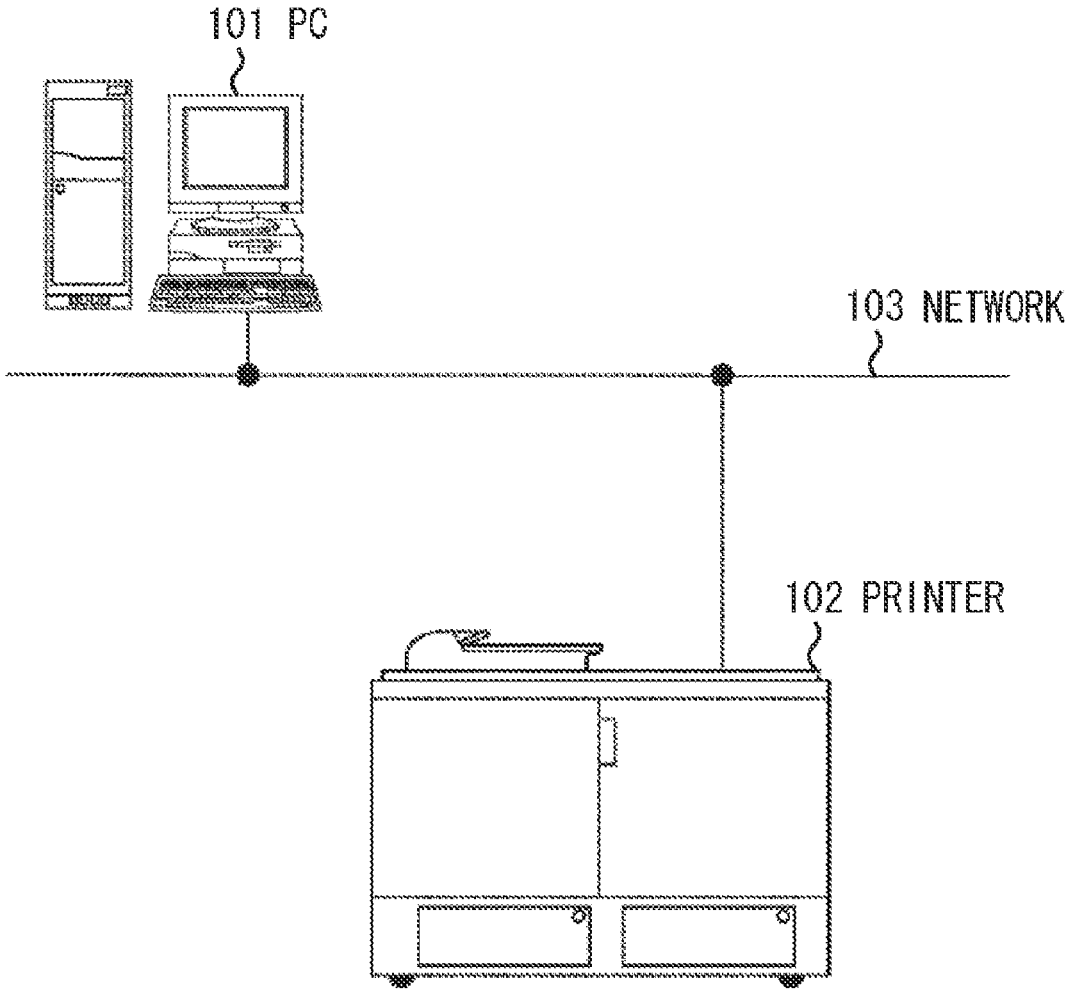
FIG. 1 illustrates a configuration of a system according to the present exemplary embodiment of the present invention.

Various exemplary embodiments, features, and aspects of the invention will be described in detail below with reference to the drawings.

In the drawings, components and parts which are identical throughout the views are designated by identical reference numerals, and their description is not repeated.

FIG. 1 illustrates a configuration of a system according to an exemplary embodiment of the present invention.

A personal computer (PC) 101 and a printer 102 are connected to each other via a network 103 in order to transmit data including image data. The PC 101 and the printer 102 may be connected to each other via a local network.

Figure 2:
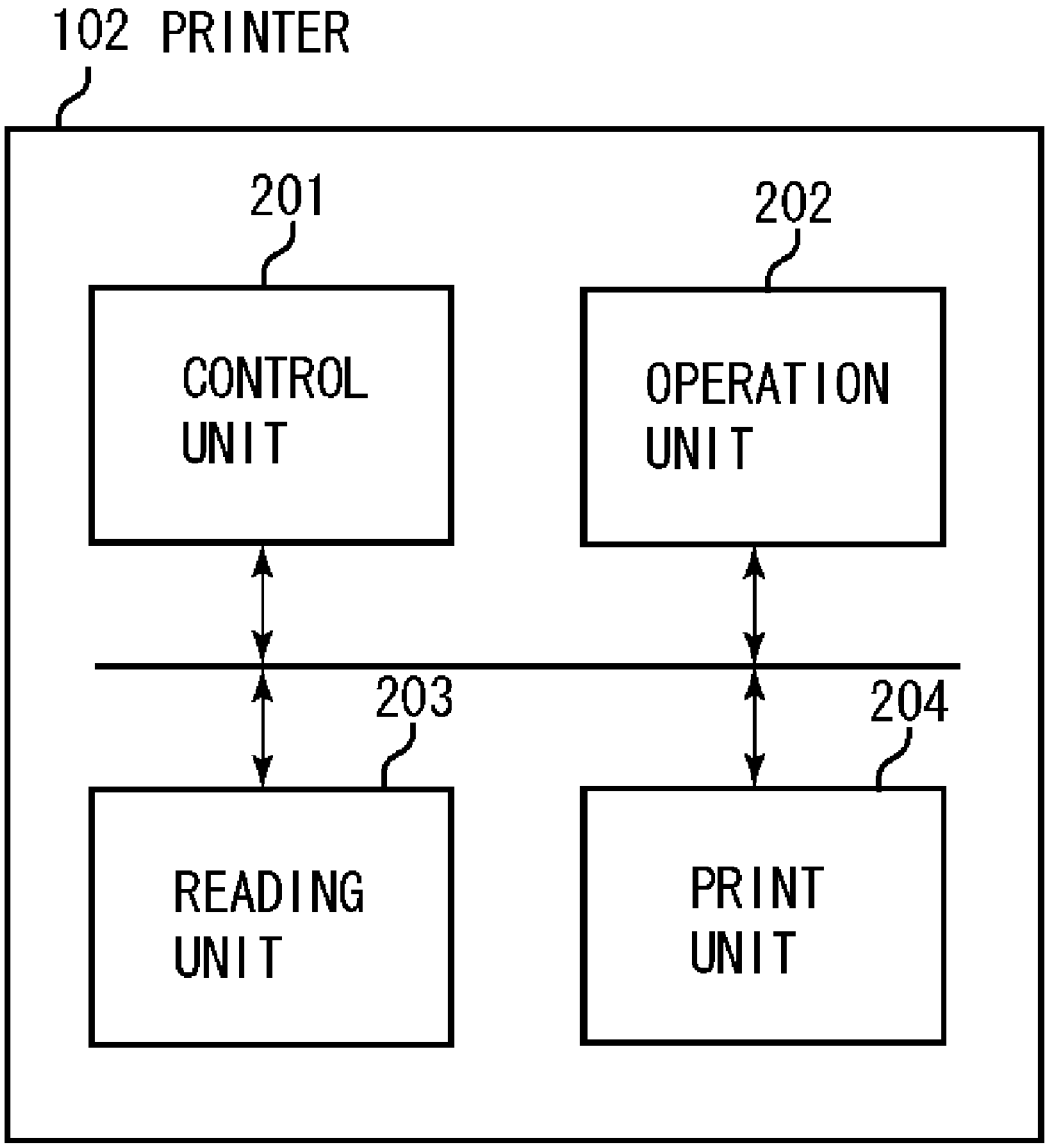
FIG. 2 is a block diagram illustrating a configuration of a printer according to the present exemplary embodiment.

FIG. 2 is a block diagram illustrating a configuration of the printer 102 according to the present exemplary embodiment.

A control unit 201 controls each of components 202 through 204 of the printer 102. The control unit 201 will be described in detail later with reference to FIG. 4. An operation unit 202 includes a display unit and an input unit. The display unit displays an operation screen of the printer 102 for a user. The input unit receives various operations from the user with respect to the printer 102. A reading unit 203 reads image data from a document and inputs thus read image data to the control unit 201. A print unit 204 transfers an image onto an output sheet based on image data having been processed by the control unit 201.

Figure 3:
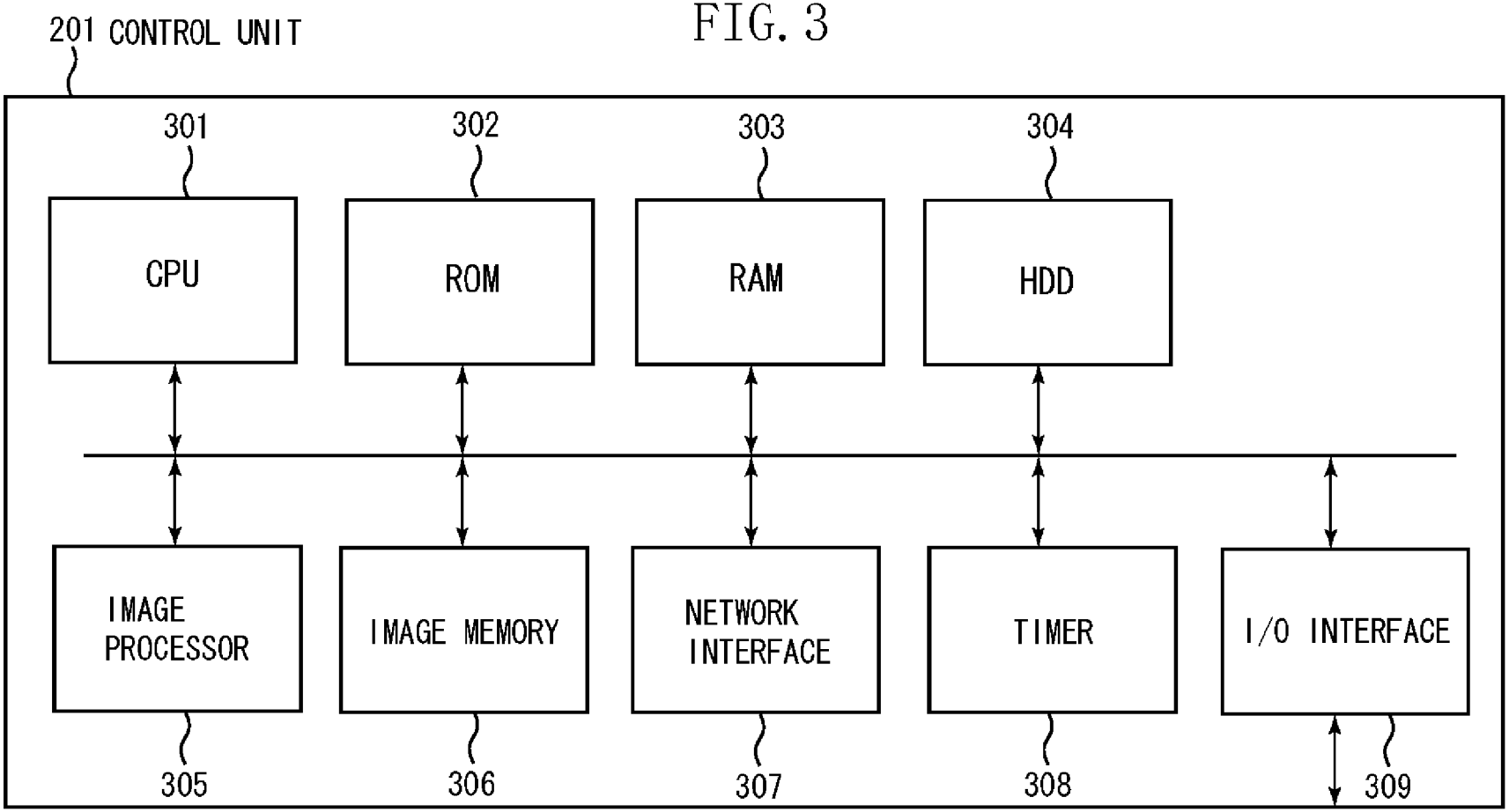
FIG. 3 is a block diagram illustrating a detailed configuration of a control unit according to the present exemplary embodiment.

FIG. 3 is a block diagram illustrating in detail the control unit 201 according to the present exemplary embodiment.

A central processing unit (CPU) 301 controls each of components 202 through 204 of the printer 102 and each of components 302 through 307 of the control unit 201 based on a program rasterized on a random access memory (RAM) 303. A read-only memory (ROM) 302 is a non-volatile storage memory which stores, for example, a boot program to be executed by the CPU 301. The RAM 303 is a volatile storage memory to which an operating system (OS) program and an application program to be executed by the CPU 301 are rasterized from a hard disk drive (HDD) 304.

The HDD 304 is a non-volatile storage memory, which stores, for example, an OS program and an application to be executed by the CPU 301. An image processor 305 performs various image processing on image data stored in an image memory 306. The image memory 306 is a volatile storage memory, which temporarily holds image data input from the reading unit 203 and a network interface 307. The network interface 307 inputs or outputs data between the printer 102 and an external apparatus such as a PC 101. A timer 308 measures time and distance intervals for conveying sheets. An input/output (IO) interface 309 inputs or outputs data between the control unit 201 and a bus connected to each of the components 202 through 204.

Figure 4:
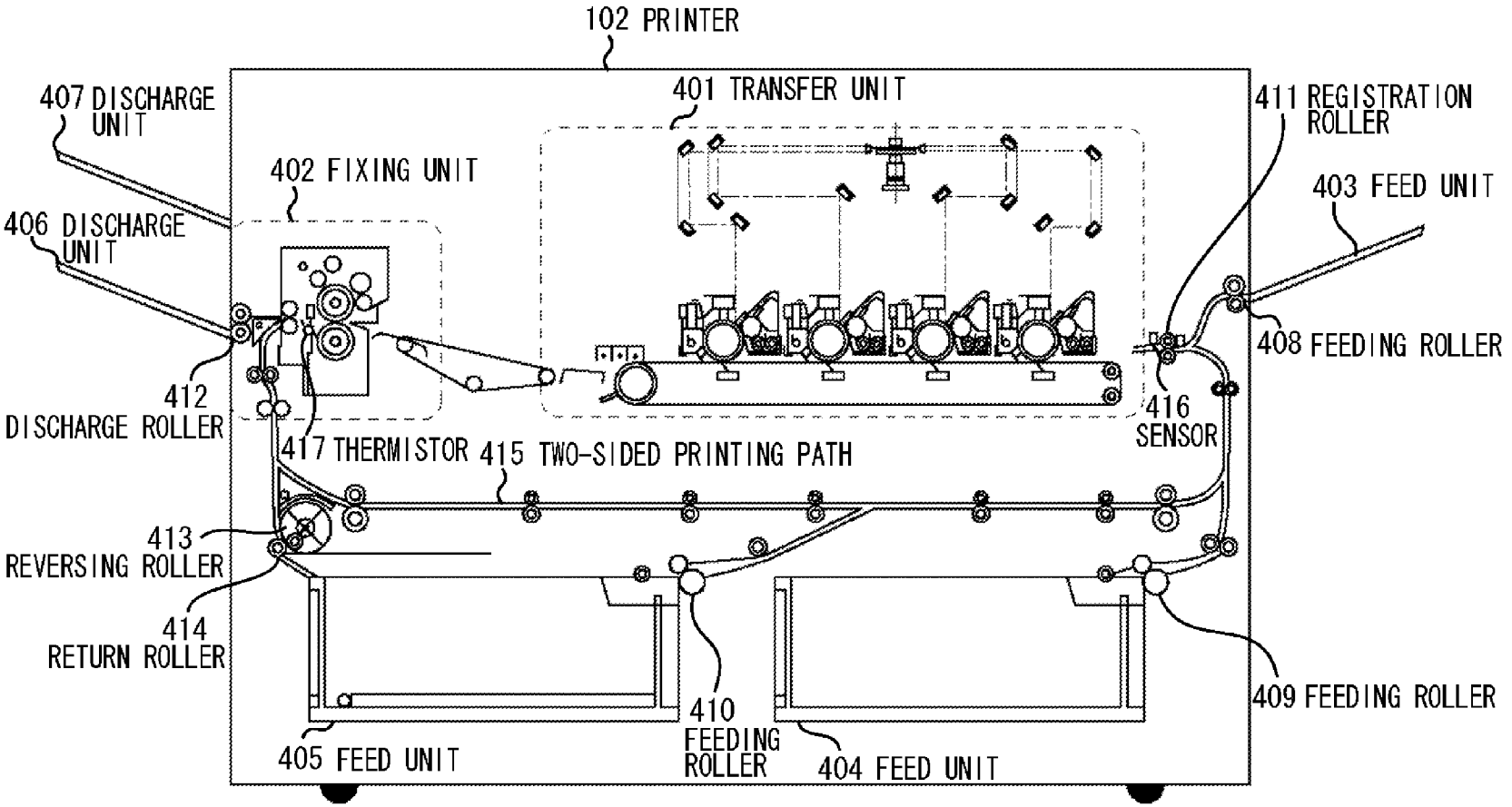
FIG. 4 is a cross sectional view of the printer according to the present exemplary embodiment.

FIG. 4 is a cross sectional view of the printer 102 according to the present exemplary embodiment.

The printer 102 includes a transfer unit 401, a fixing unit 402, a feed unit 403 (404, 405), a discharge unit 406 (407), a feeding roller pair 408 (409, 410), a registration roller pair 411, a discharge roller pair 412, a reversing roller 413, a return roller pair 414, a two-sided printing path 415, a sensor 416, and a thermistor 417.

A print processing of the print unit 204 is performed in a manner as described below by causing the CPU 301 to control each of the components of the printer 102. A sheet is fed from the feed unit 403 (404, 405) by the feeding roller pair 408 (409, 410). Thus, fed sheet is supplied to the transfer unit 401 by the registration roller pair 411. The transfer unit 401 transfers a developer image onto thus supplied sheet. The fixing unit 402 fixes the developer image on the sheet to which the developer image was transferred by the transfer unit 401. The sheet after the image was fixed is discharged to the discharge unit 406 (407) through the discharge roller pair 412.

When a blank sheet discharged during the cycle down prevention printing is returned to the feed unit, the blank sheet is returned to the feed unit 405 through the return roller pair 414. In the case of two-sided printing, when an image was fixed only on one of the sheet surfaces, the sheet is reversed by the reversing roller 413, is passed through the two-sided printing path 415, and is conveyed to the registration roller pair 411. As far as no cycle down occurs, sheets might be conveyed to the fixing unit 402 from the transfer unit 401 at equal time intervals or distance intervals from preceding sheets.

If the sheets are conveyed at equal distance intervals, a next sheet will be started to be fed at a time when the sensor 416 detects a trailing edge of the preceding sheet. Accordingly, the preceding sheets and the subsequent sheets will be fed at constant conveying intervals. If the sheets are conveyed at equal time intervals, the timer 308 starts measuring the time intervals at a time when the sensor 416 detects the leading edge or the trailing edge of the preceding sheet. When the timer 308 measures a predetermined time interval, the next sheet will be started to be fed. Accordingly, a time interval can be set at a constant sheet conveyance interval between the preceding sheet and the subsequent sheet.

The transfer unit 401 includes photosensitive members, charging units, exposure units, and development units. The photosensitive member transfers an image onto a sheet. The charging unit charges the photosensitive member. The exposure unit forms an electrostatic latent image by exposing the charged photosensitive member to a laser. The development unit develops the electrostatic latent image formed on the photosensitive member by using a developer (for example, a toner).

The transfer unit 401 performs transfer processing in a following manner by causing the CPU 301 to control each of components of the transfer unit 401. The CPU 301 converts the bit map data generated during the image processing into data of laser irradiation light. The charging unit charges the photosensitive member. The exposure unit exposes thus charged photosensitive member to light, based on the data of thus converted laser irradiation light, to form the electrostatic latent image. The development unit develops the electrostatic latent image formed on the photosensitive member by using a developer (for example, a toner).

In the present exemplary embodiment, each image data of the plurality of pages is processed, and a developer image is transferred onto and fixed on each of the corresponding plurality of sheets. When an arbitrary page is named as a first page from among the image data of the plurality of pages, a page following the first page will be named as a second page. If an arbitrary sheet is named as a first sheet from among the plurality of sheets, a sheet following the first sheet will be named as a second sheet, and, in the same manner, a sheet following the second sheet will be named as a third sheet.

Figure 5:
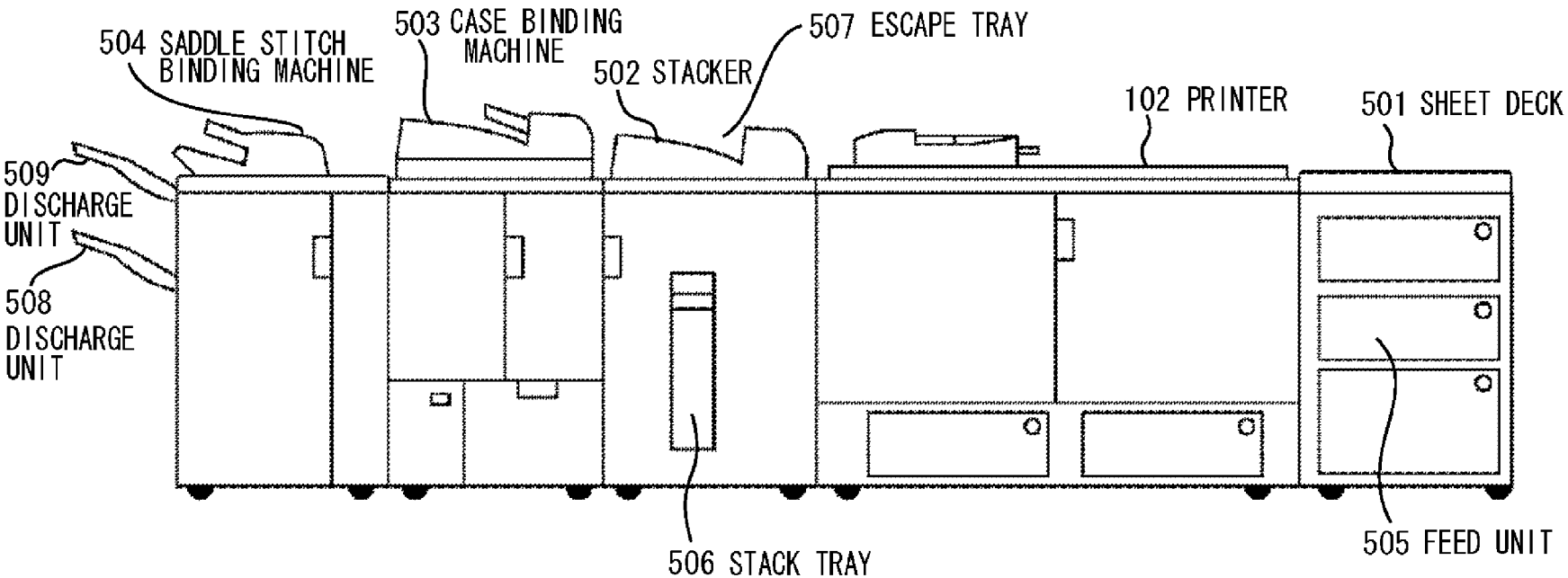
FIG. 5 is an outer appearance of the printer according to the present exemplary embodiment.

FIG. 5 illustrates an outer appearance of the printer 102 according to the present exemplary embodiment. FIG. 5 specifically illustrates a state of the printer 102 to which various sheet processing apparatus are connected.

Figure 13:
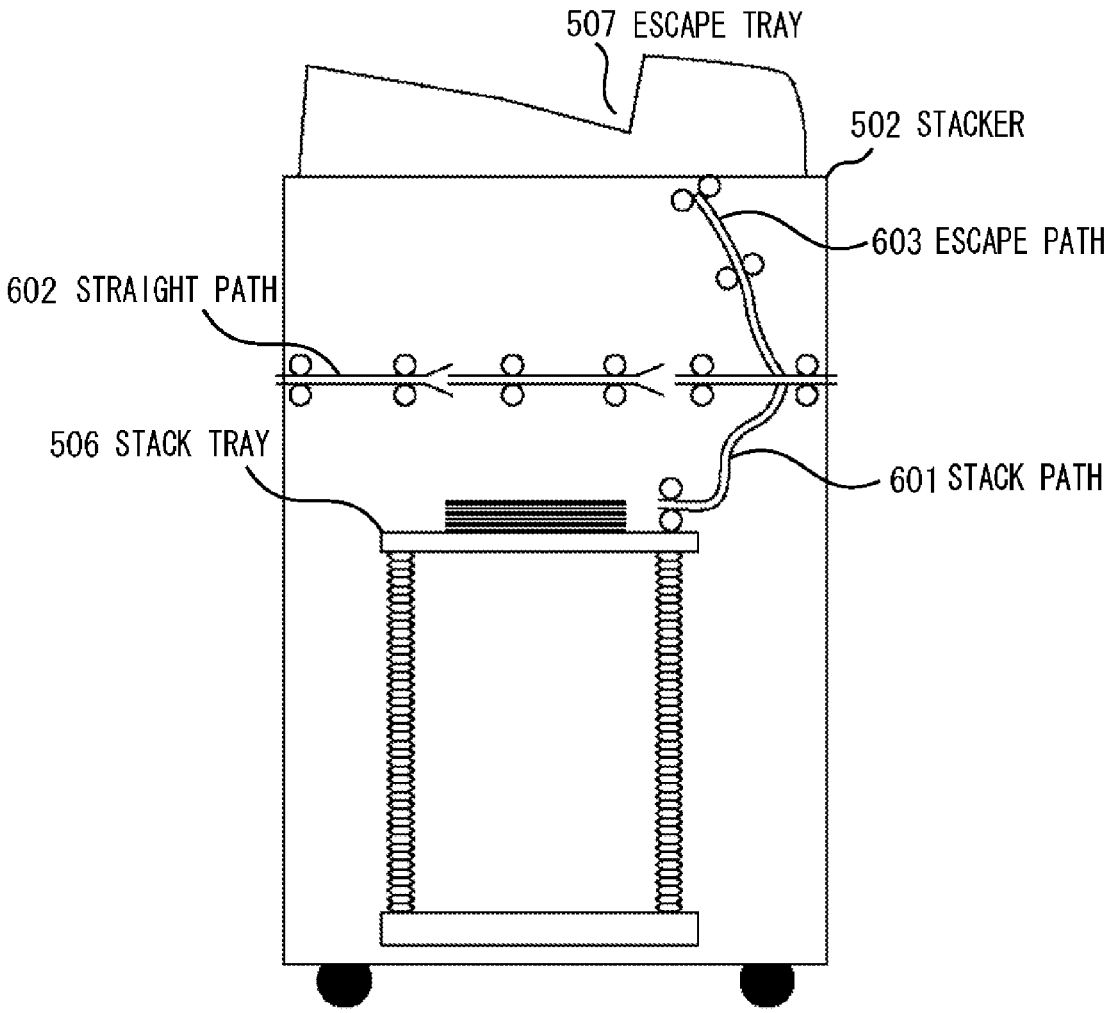
FIG. 13 is a cross sectional view of a stacker according to the present exemplary embodiment.

A sheet deck 501 can accommodate a large amount of sheets to be fed to the printer 102. The sheet deck 501 includes a feed unit 505. A stacker 502 can accommodate a large amount of sheets discharged from the printer 102. The stacker 502 includes a stack tray 506 which stacks printed sheets and an escape tray 507 which discharges a sheet printed, for example, as a test print. FIG. 13 is a cross sectional view of the stacker 502 according to the present exemplary embodiment. When the sheets are discharged to the stack tray 506, the sheets are conveyed through a stack path 601.

Further, when the sheets are conveyed to a case binding machine 503 or a saddle stitch binding machine 504, the sheets are conveyed through a straight path 602. When the sheets are discharged to the escape tray 507, the sheets might be conveyed through an escape path 603. The case binding machine 503 can bind the sheets which have been printed by the printer 102 in the form of the case binding. The saddle stitch binding machine 503 can bind the sheets which have been printed by the printer 102 in the form of the saddle stitch binding. The saddle stitch binding machine 504 may have functions of a stapler, an inserter, a sheet folding machine, and/or a paper cutting machine, in addition to a function of the saddle stitch binding machine. The sheet processing apparatus can be coupled to or decoupled from the image forming apparatus independently in a freely combined manner and in a free coupling order. A rear stage of the saddle stitch binding machine 504 is provided with a discharge unit 508 and a discharge unit 509.

In the present exemplary embodiment, a job includes copying, printing, FAX, SEND, and BOX jobs. In the copying job, image data read by the reading unit 203 is printed by the print unit 204. In the printing job, the image data received from the PC 101 through the network interface 307 is printed by the print unit 204. In the FAX job, the image data read by the reading unit 203 is transferred or received by using a telephone line. In the SEND job, the image data read by the reading unit 203 is transferred or received by using the network 103. In the BOX job, the image data read by the reading unit 203 is stored in a storage medium such as the HDD 304.

Figure 6:
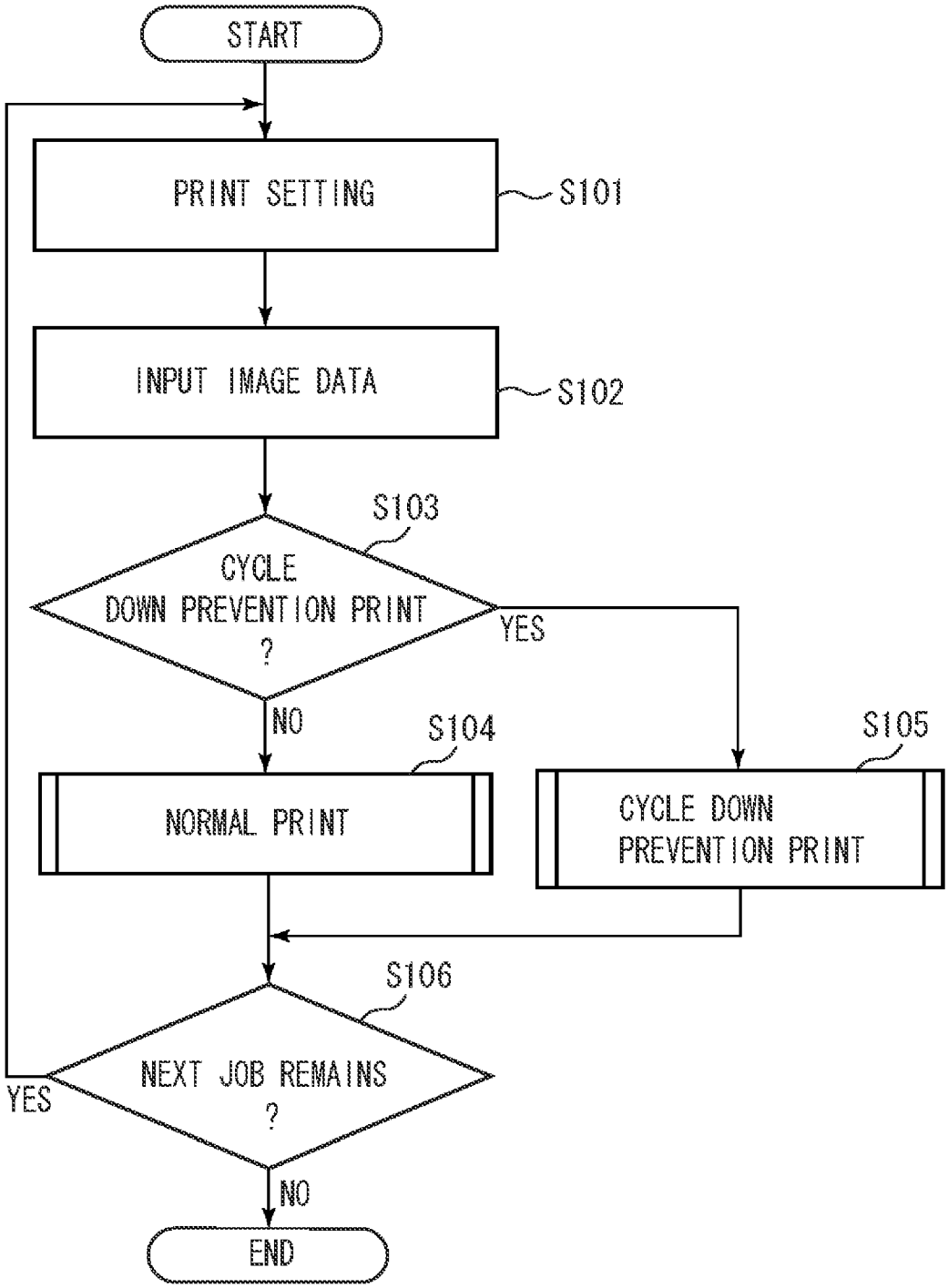
FIG. 6 is a flow chart illustrating a print operation of the printer according to the present exemplary embodiment.

FIG. 6 is a flow chart illustrating a printing operation of the printer 102 according to the present exemplary embodiment. The operation illustrated in the flow chart can be realized by causing the CPU 301 to read a program stored in the HDD 304 and execute thus read program on the RAM 303.

In step S101, the CPU 301 performs print setting of the printer 102 according to an operation of the user through the operation unit 202. In the print setting, a print mode setting according to the present exemplary embodiment will be also performed in addition to a normal print setting. The operation of step S101 may be omitted if the print setting has already been completed.

Figure 8:
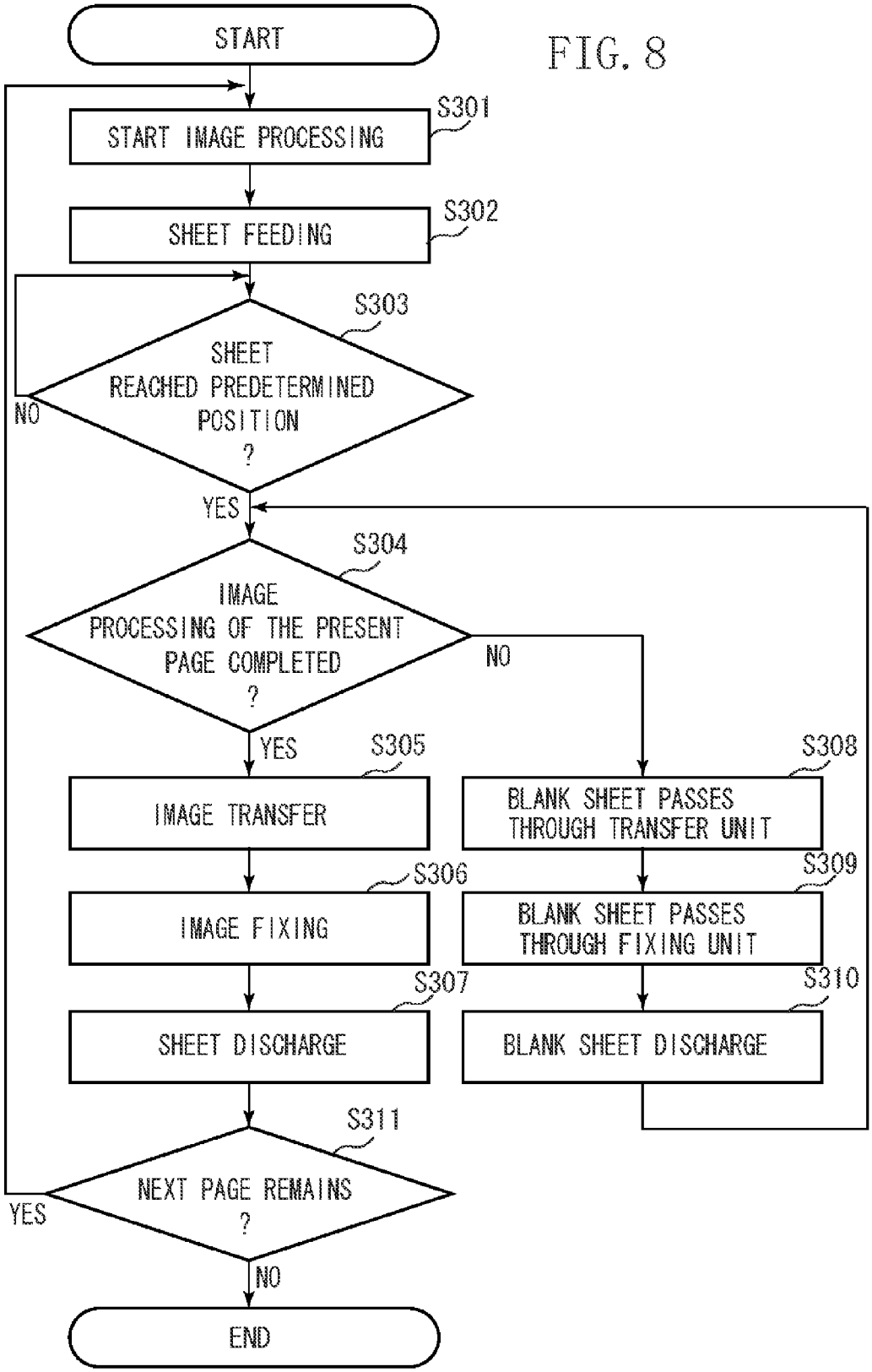
FIG. 8 is a flow chart illustrating a detailed printing step for preventing cycle down according to the present exemplary embodiment.
Figure 9:
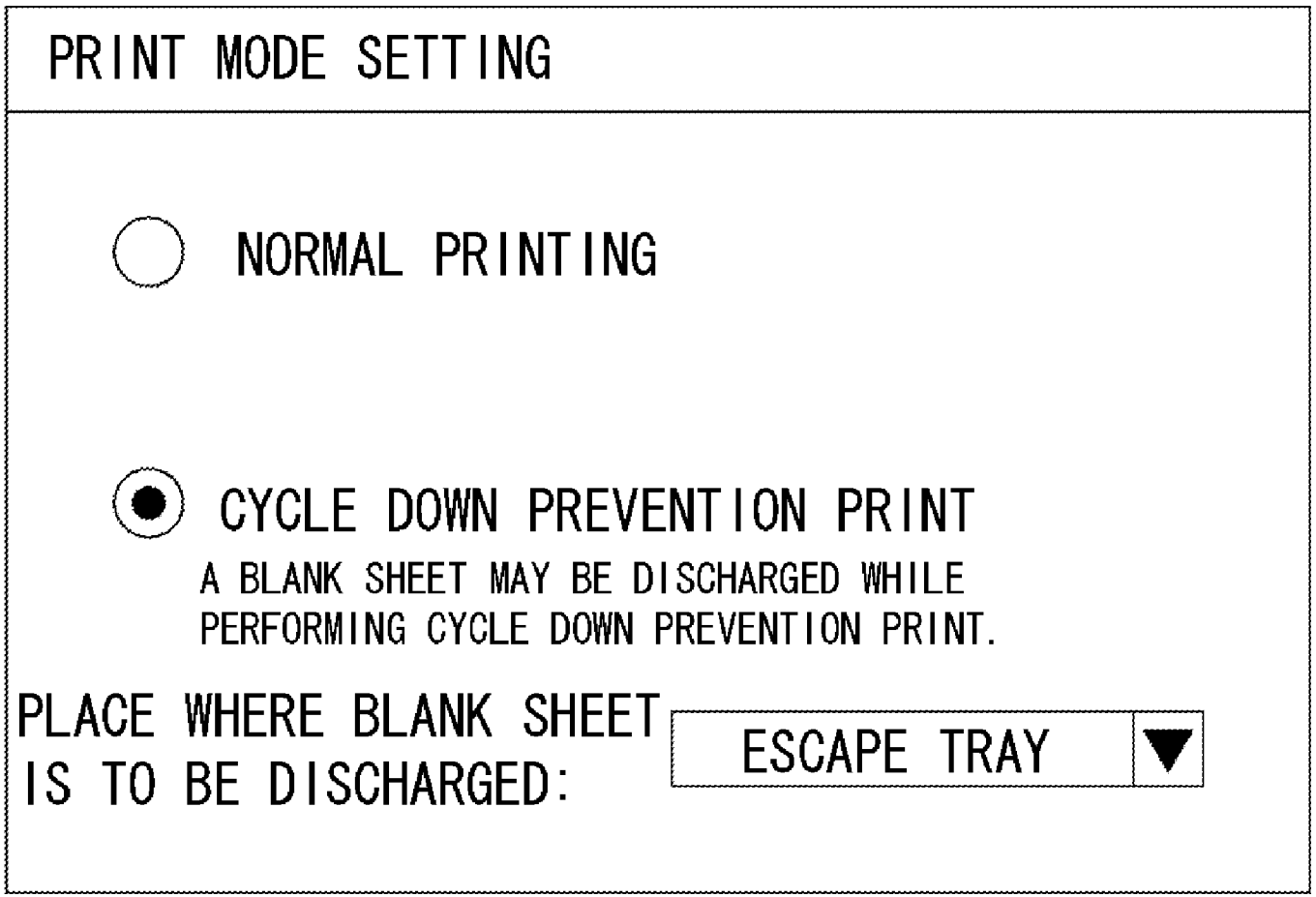
FIG. 9 illustrates a screen displayed on an operation unit when setting a print mode in a print setting step according to the present exemplary embodiment.
Figure 10:
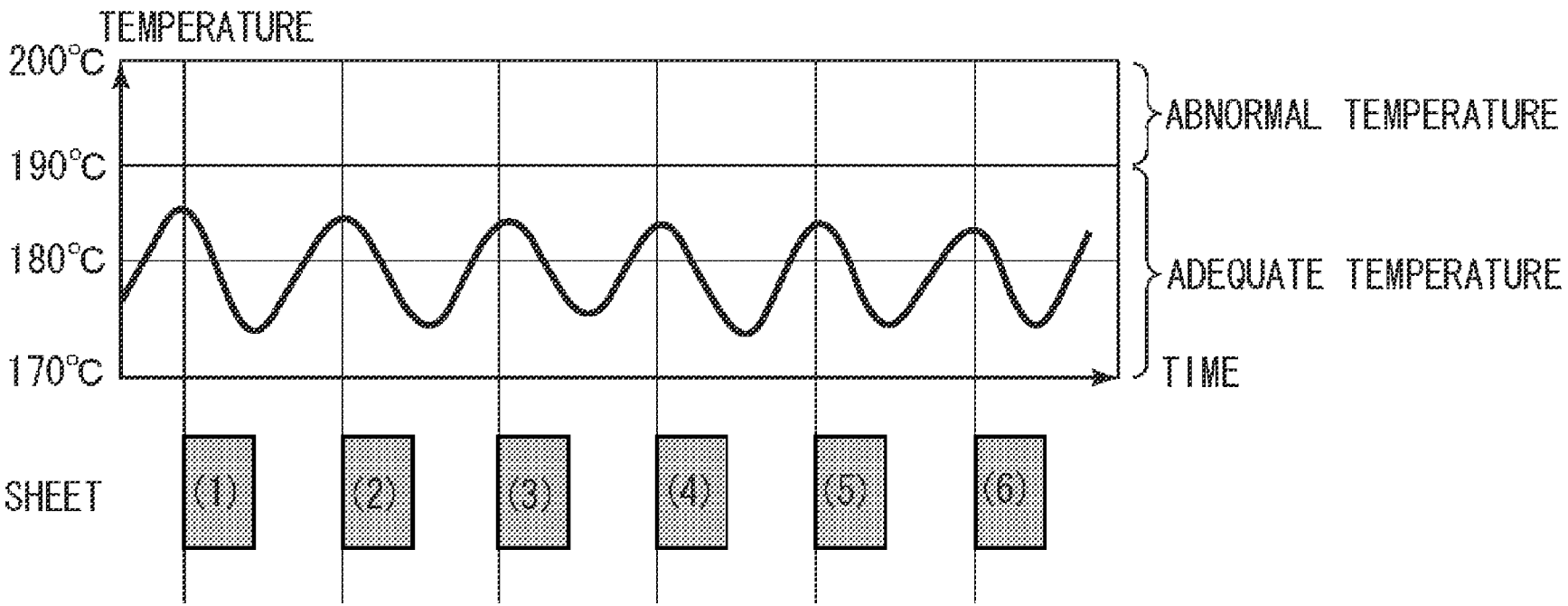
FIG. 10 illustrates a temperature change of a fixing unit when a normal printing is performed with respect to a plurality of pages.
Figure 11:
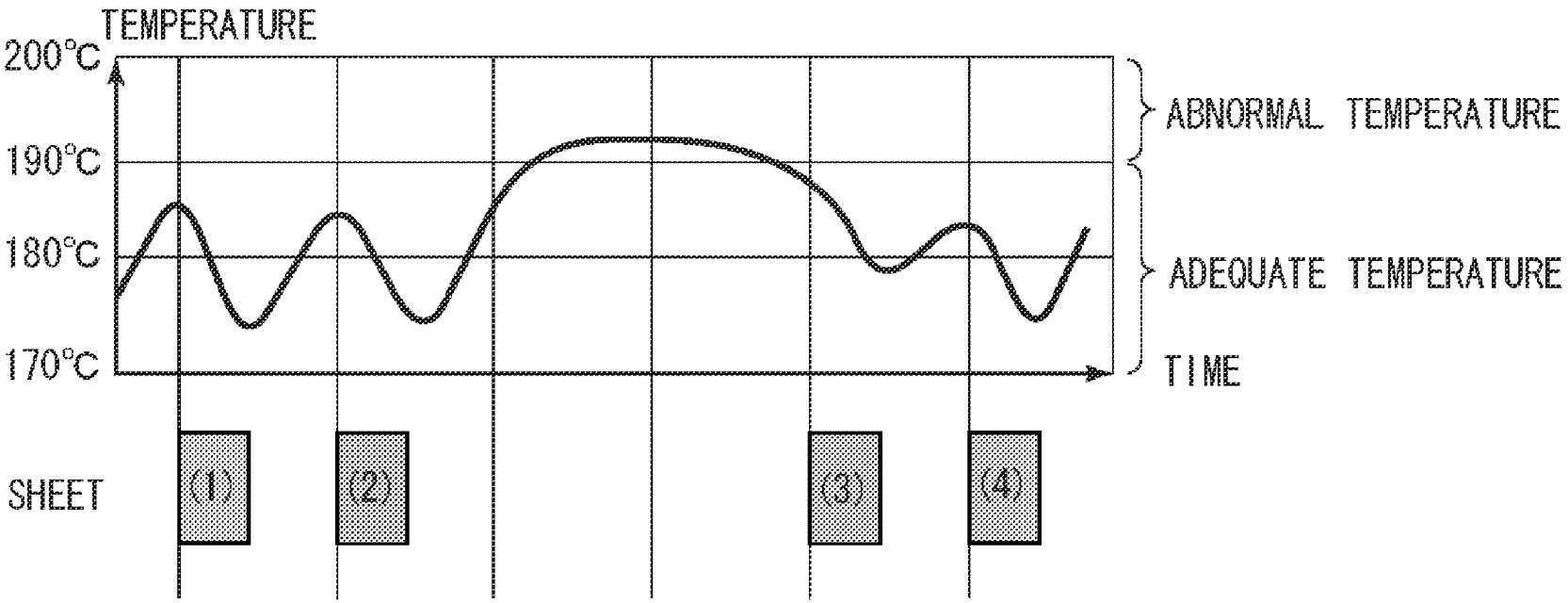
FIG. 11 illustrates a temperature change of the fixing unit when a cycle down occurs in printing a plurality of pages.

FIG. 9 illustrates a screen displayed on the operation unit 202 when a print mode is set in step S101 according to the present exemplary embodiment. In FIG. 9, the print mode can be selected from two modes, i.e., a normal print mode and a cycle down prevention print mode. The normal print is a conventional print mode (which will be described later with reference to FIG. 7), i.e., a print mode in which a cycle down may occur in the print unit 204 due to temperature increase of the fixing unit 402. The cycle down prevention print is a print mode unique to the present exemplary embodiment (which will be described later with reference to FIG. 8), i.e., a print mode in which a cycle down would not occur in the print unit 204 due to temperature increase of the fixing unit 402.

In the cycle down prevention print, if it takes time to process an image in the image processor 305, a blank sheet onto which no image is transferred by the transfer unit 401 might be conveyed to the fixing unit 402 to prevent the temperature increase of the fixing unit 402. In FIG. 9, when the user selects the cycle down prevention print, the user also can select a place where the blank sheet is discharged. The feed unit 405, the discharge unit 406, or the discharge unit 407 is usually selectable to discharge the blank sheet. Further, if various sheet processing apparatus are connected to the printer 102, the stack tray 506, the escape tray 507, the discharge unit 508, or the discharge unit 509 is also selectable to discharge the blank sheet.

In step S102, image data to be printed by the printer 102 is input through the network interface 307 (or the reading unit 203).

In step S103, the CPU 301 determines whether the cycle down prevention print is set in step S101. If the CPU 301 determines in step S103 that the cycle down prevention print is not set in step S101 (NO in step S103), the processing goes to step S104. If the CPU 301 determines in step S103 that the cycle down prevention print is set in step S101 (YES in step S103), the processing goes to step S105.

If the CPU 301 determines in step S103 that the cycle down prevention print is not set (NO in step S103), the image data input in step S102 is printed in the normal print mode. The normal printing will be described later in detail with reference to FIG. 7.

If the CPU 301 determines in step S103 that the cycle down prevention print is set in step S101 (YES in step S103), the image data input in step S102 is printed in the cycle down prevention print mode. The cycle down prevention print will be described later in detail with reference to FIG. 8.

In step S106, the CPU 301 determines whether there remains a job to be performed. If the CPU 301 determines in step S106 that there remains a job to be performed (YES in step S106), the processing goes to step S102. If the CPU 301 determines in step S106 that no job to be performed remains (NO in step S106), the CPU 301 ends the processing.

Figure 7:
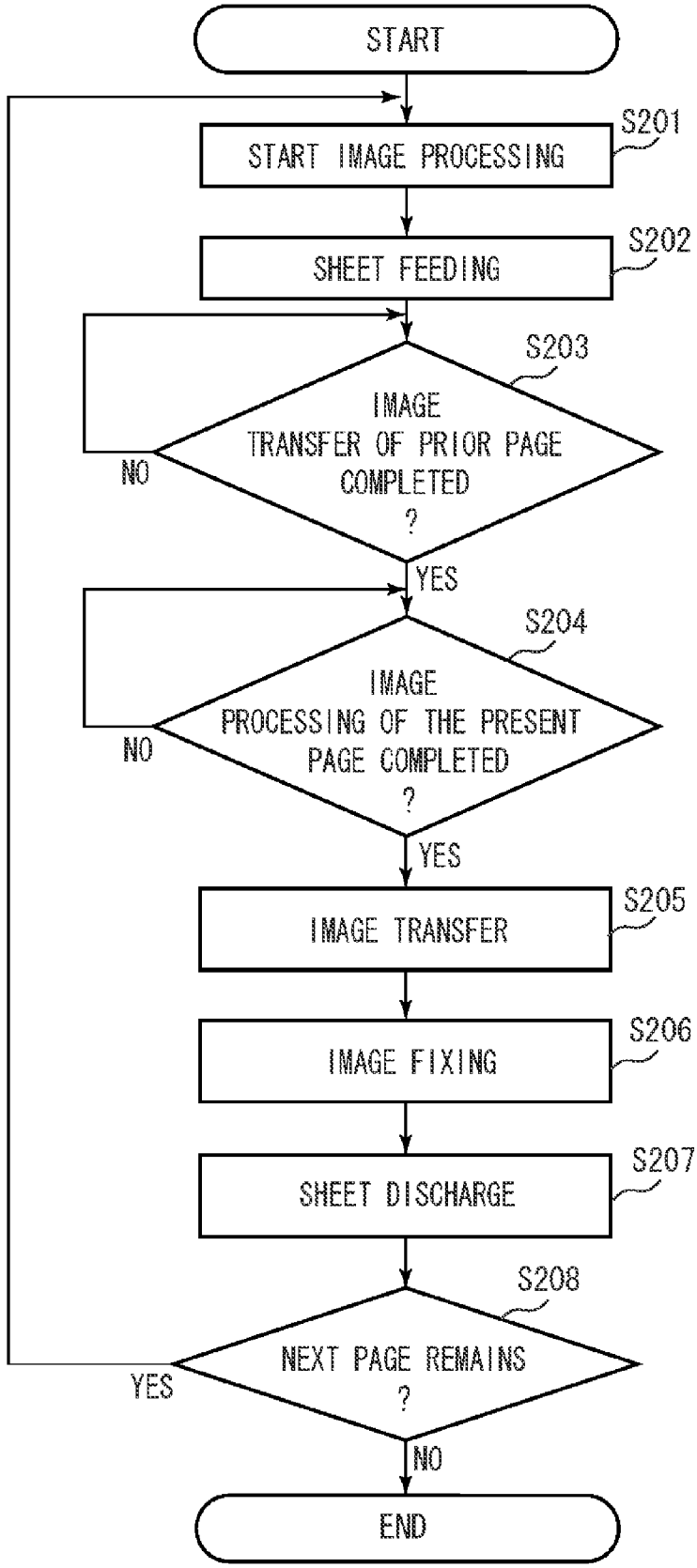
FIG. 7 is a flow chart illustrating a detailed normal printing step according to the present exemplary embodiment.

FIG. 7 is a flow chart illustrating in detail the normal print of step S104 according to the present exemplary embodiment. An operation illustrated in this flow chart is realized by causing the CPU 301 to read a program stored in the HDD 304 to execute the program on the RAM 303.

In step S201, the CPU 301 causes the image processor 305 to start processing the image data input in step S102. The image processing includes an image processing that converts, for example, a page description language type image data into a bit map type image data. In step S202, a sheet is fed from the feed unit 403 (404, or 405) by the feeding roller pair 408 (409, or 410). The registration roller pair 411 stops conveying thus fed sheet until the image processing started in step S201 is completed.

In step S203, the CPU 301 determines whether the image transfer unit 401 completes transfer of the image data of a page prior to the image data which has started to be processed in step S201. If the CPU 301 determines in step S203 that the image transfer processing is completed (YES in step S203), the processing goes to step S204. If the CPU 301 determines in step S203 that the image transfer processing is not completed (NO in step S203), the CPU 301 waits for the completion of the image transfer processing.

In step S204, the CPU 301 determines whether the image processing which started in step S201 was completed. If the CPU 301 determines in step S204 that the image processing is completed (YES in step S204), the processing goes to step S205. If the CPU 301 determines in step S204 that the image processing is not completed (NO in step S204), the CPU 301 waits for the completion of the image processing. If a temperature of the fixing unit 402 becomes equal to or more than a predetermined value while the CPU 301 is waiting for the completion of the image processing, the CPU 301 once stops a power supply to the fixing unit 402 and then waits for the temperature of the fixing unit 402 to be less than the predetermined value. The fixing unit 402 is provided with a thermistor 417 as a temperature detection unit. The CPU 301 determines the temperature of the fixing unit 402 with reference to a table for converting a voltage value to a temperature value based on a voltage value corresponding to the temperature of a surface of the fixing unit 402 output from the thermistor 417. When the temperature determined by the CPU 301 becomes less than the predetermined value, the CPU 301 once stops the power supply to the fixing unit 402 and then waits for the temperature determined by the CPU 301 to be equal to or more than the predetermined value.

Steps S203 and S204 may be performed before step S202 instead of after step S202. In this case, the sheet feeding operation of step S202 will be performed after steps S203 and S204 and before step S205.

In step S205, the transfer unit 401 transfers the image onto the sheet fed in step S202 based on the image data having already been processed in step S204. In step S206, the fixing unit 402 fixes the image onto the sheet to which the image was transferred in step S205. In step S207, the discharge roller pair 412 discharges the sheet, on which the image has been fixed in step S206, to the discharge unit 406 (or 407).

In step S208, the CPU 301 determines whether a page to be printed remains. If the CPU 301 determines in step S208 that the page to be printed remains (YES in step S208), the processing goes to step S201. If the CPU 301 determines in step S208 that a page to be printed does not remain (NO in step S208), the CPU 301 ends the processing.

FIG. 8 is a flow chart illustrating a detailed operation of the cycle down prevention print of step S105 according to the present exemplary embodiment. The operation illustrated in this flow chart is realized by causing the CPU 301 to read a program stored in the HDD 304 and execute the program on the RAM 303.

In step S301, the image processor 305 starts processing the image data input in step S102. An example of the image processing includes processing in which page description language type image data is converted into a bit map type image data. In step S302, a sheet is fed at constant time intervals from the feed unit 403 (404, or 405) by the feeding roller pair 408 (409, or 410).

In step S303, the CPU 301 determines whether the sheet fed in step S302 is conveyed and reaches a predetermined position on a convey path. The predetermined position means, for example, a position of the registration roller pair 411, the feeding roller pairs 408, 409, 410, or a not-shown convey roller pair. Sensors are not illustrated other than the sensor 416 (the sensor positioned near the registration roller pair 411) in the drawing, however, they can be provided at any positions. An arrival of the sheet at the predetermined position may be directly detected by a sensor provided at the predetermined position, or may be indirectly detected by causing the CPU 301 to calculate a sheet conveyance time based on the feeding position of the sheet and the predetermined position. If the CPU 301 determines in step S303 that the sheet has reached the predetermined position (YES in step S303), the processing goes to step S304. If the CPU 301 determines in step S303 that the sheet has not yet reached the predetermined position (NO in step S303), the CPU 301 waits for the arrival of the sheet at the predetermined position.

In step S304, the CPU 301 determines whether the image processing started in step S301 is completed. If the CPU 301 determines in step S304 that the image processing has been completed (YES in step S304), the processing goes to step S305. If the CPU 301 determines in step S304 that the image processing has not yet been completed (NO in step S304), the processing goes to step S308.

Steps S303 and S304 may be performed before step S302 instead of after step S302. In this case, the sheet feeding processing of step S302 is performed after steps S303 and S304 and before step S305 or step S308.

In step S305, if the CPU 301 determines in step S304 that the image processing has been completed (YES in step S304), the transfer unit 401 starts to transfer an image onto the sheet fed in step S301 based on the image data having been processed in step S304. In step S306, the fixing unit 402 starts to fix the image onto the sheet to which the image transfer processing has been started in step S305. In step S307, the discharge roller pair 412 discharges the sheet, as to which the image fixation processing has been started in step S306, to the discharge unit 406 (or 407).

In step S308, if the CPU 301 determines in step S304 that the image processing has not been completed (No in step S304), the transfer unit 401 performs no image transfer processing with respect to the sheet fed in step S302 but passes the sheet through the transfer unit 401 as it is in a blank state. In step S309, the fixing unit 402 causes the blank sheet having passed through the transfer unit 401 in step S308 to further pass through the fixing unit 402 as it is in a blank state. In step S310, the discharge roller pair 412 discharges the blank sheet having passed through the fixing unit 402 in step S309 to the discharging place set in step S101. After step S310, the processing goes to step S304.

In step S311, the CPU 301 determines whether there remains a page to be printed. If the CPU 301 determines in step S311 that there remains a page to be printed (YES in step S311), the processing goes to step S301. If the CPU 301 determines in step S311 that no page to be printed remains (NO in step S311), the CPU 301 ends the processing.

Figure 12:
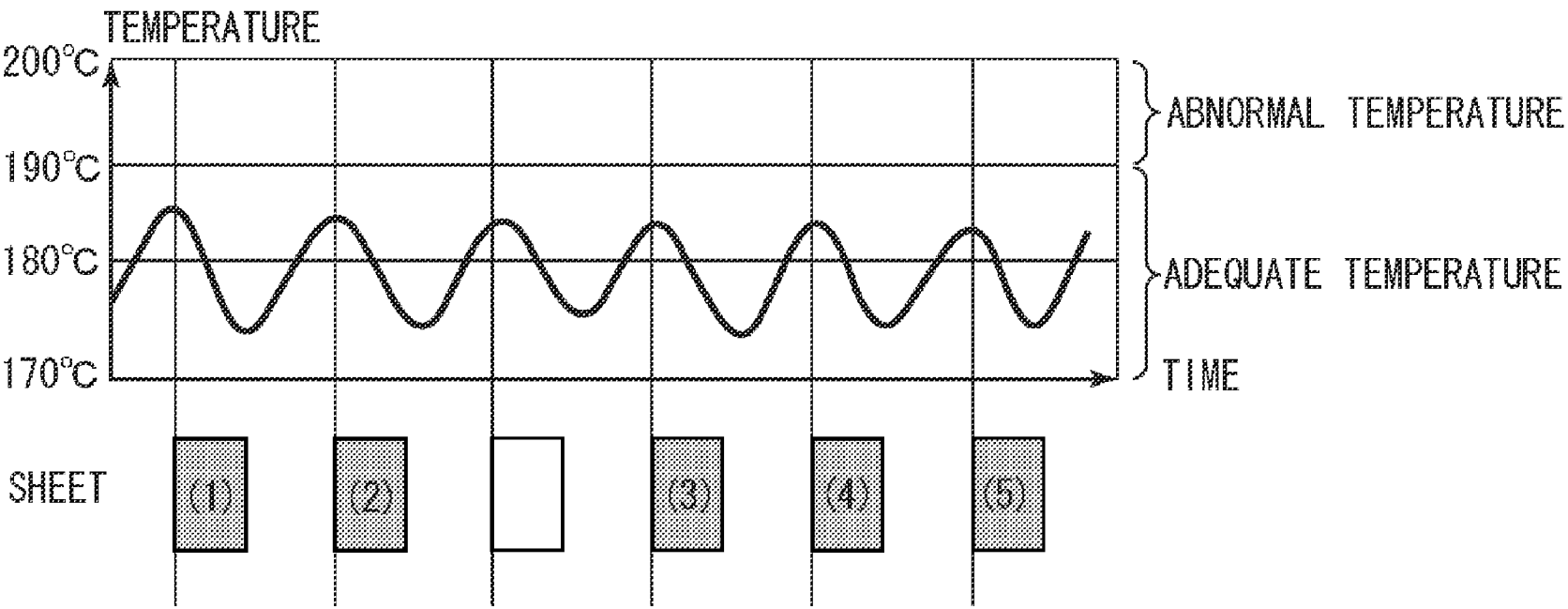
FIG. 12 illustrates a temperature change of the fixing unit when a cycle down prevention print according to the present exemplary embodiment is performed.

FIG. 12 illustrates a temperature change of the fixing unit 402 when the cycle down prevention print according to the present exemplary embodiment is performed. In FIG. 12, since it took accidentally longer time to process the image data of a third page after the image transfer processing and the image fixation processing of a second page, the fixing unit 402 passes a blank sheet through the fixing unit. Thus, the cycle down of the printer 102 can be prevented. In FIG. 12, because the fixing unit 402 passes the blank sheet through the fixing unit, the image transfer processing and the image fixation processing can be performed with respect to the image data of the third page immediately after the image processing thereof while the temperature of the fixing unit 402 does not exceed the temperature adjustment area.

According to an aspect of the present exemplary embodiment, even if it takes time to process the image in the printing apparatus, the cycle down due to temperature increase of the fixing unit 402 can be prevented.

The present invention can also be achieved by causing the above described system or apparatus to read from a storage medium and execute a program of software which realizes functions of the above described present exemplary embodiment.

In this case, the program itself read from the storage medium will realize a new function of the present invention, and thus the program and the storage medium storing the program will be also encompassed within the scope of the present invention.

Examples of the storage medium which provides program codes may include a floppy disk, a hard disk, a ROM, an optical disk, a magnetic optical disk, a compact disk-read only memory (CD-ROM), a digital versatile disk-read only memory (DVD-ROM), a DVD-RAM, a magnetic tape, and a memory card.

Further, a part of or the entire of an actual processing can also be performed by an operating system (OS) running on a computer based on an instruction of the program and thereby the above described functions of the present exemplary embodiment are realized by the processing.

Further, after the program is written in a memory installed in a function expansion unit connected to a computer, a part of or an entire of an actual processing may be performed by a CPU of the function expansion unit to realize the above described functions of the present exemplary embodiment by the processing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-159668 filed Jun. 18, 2008, which is hereby incorporated by reference herein in its entirety.

What is claimed is:

1. An image forming apparatus comprising:

an input unit configured to input image data;

an image processing unit configured to process the image data;

a transfer unit configured to form a developer image corresponding to the processed image data on a photosensitive member and transfer the developer image onto a sheet;

a fixing unit configured to fix the developer image on the sheet;

a conveyance unit configured to convey a plurality of sheets at predetermined conveying intervals from a predetermined position on a conveyance path to the transfer unit and the fixing unit; and a control unit configured to control the transfer unit and the fixing unit such that, in case that a second sheet following a first sheet is conveyed from the predetermined position by the conveyance unit after the first sheet has been conveyed to fix a developer image corresponding to processed image data of a first page by the conveyance unit, a developer image corresponding to image data of a second page is transferred onto the second sheet by the transfer unit and the second sheet is conveyed to the fixing unit if an image processing with respect to the image data of the second page following the first page has been completed, whereas the developer image corresponding to the image data of the second page is not transferred onto the second sheet by the transfer unit but the second sheet is conveyed to the fixing unit if the image processing with respect to the image data of the second page has not been completed.

2. The image forming apparatus according to claim 1, wherein the input unit inputs image data from a reading unit or an external apparatus.

3. The image forming apparatus according to claim 1, wherein the image processing unit rasterizes the image data input by the input unit, from page description language data to bit map data.

4. The image forming apparatus according to claim 1, wherein the transfer unit and the fixing unit are controlled by the control unit such that, in case that a third sheet following the second sheet is conveyed from the predetermined position by the conveyance unit after the second sheet has been conveyed to the fixing unit without transferring the developer image corresponding to the image data of the second page by the transfer unit to the second sheet, the transfer unit transfers the developer image corresponding to the image data of the second page to the third sheet and the third sheet is conveyed to the fixing unit if the image processing with respect to the image data of the second page has been completed, whereas the third sheet is conveyed to the fixing unit without transferring the developer image corresponding to the image data of the second page to the third sheet by the transfer unit if the image processing with respect to the image data of the second page has not been completed.

5. The image forming apparatus according to claim 1, further comprising:

a setting unit configured to set a cycle down prevention print mode which prevents cycle down in the image forming apparatus;

wherein the control unit performs the control in case that the cycle down prevention print mode is set by the setting unit.

6. The image forming apparatus according to claim 1, further comprising:

a plurality of discharge units;

wherein the second sheet is conveyed to the fixing unit without transferring the developer image corresponding to the image data of the second page onto the second sheet by the transfer unit, and is discharged to a discharge unit different from a discharge unit to which the second sheet conveyed to the fixing unit is discharged after the developer image corresponding to the image data of the second page is transferred by the transfer unit.

7. The image forming apparatus according to claim 6, further comprising:

a designation unit configured to designate one of the plurality of discharge units;

wherein the second sheet is conveyed to the fixing unit without transferring the developer image corresponding to the image data of the second page by the transfer unit, and is discharged to one of the discharge units designated by the designation unit.

8. The image forming apparatus according to claim 6, wherein the second sheet is conveyed to the fixing unit without transferring the developer image corresponding to the image data of the second page by the transfer unit, and is discharged to a feed unit of the image forming apparatus.

9. The image forming apparatus according to claim 6, wherein the second sheet is conveyed to the fixing unit without transferring the developer image corresponding to the image data of the second page by the transfer unit, and is discharged to an escape tray of a stacker which is connected to the image forming apparatus.

10. A method of controlling an image forming apparatus including a transfer unit and a fixing unit, comprising:

inputting image data;

processing the input image data;

forming a developer image corresponding to the processed image data on a photosensitive member and transferring the developer image onto a sheet by the transfer unit;

fixing the transferred developer image onto the sheet by the fixing unit;

conveying a plurality of sheets to the transfer unit and the fixing unit at predetermined conveyance intervals from a predetermined position on a conveyance path; and controlling the transfer unit and the fixing unit such that, in case that a second sheet following a first sheet is conveyed from the predetermined position after conveying the first sheet on which the developer image corresponding to the processed image data of a first page is fixed, a developer image corresponding to image data of a second page is transferred to the second sheet by the transfer unit if an image processing with respect to the image data of the second page following the first page has been completed and the second sheet is conveyed to the fixing unit, whereas the second sheet is conveyed to the fixing unit without transferring the developer image corresponding to the image data of the second page to the second sheet by the transfer unit if the image processing with respect to the image data of the second page has not been completed.

* * * * *